US010596828B2

(12) United States Patent
Hirano et al.

(10) Patent No.: US 10,596,828 B2
(45) Date of Patent: Mar. 24, 2020

(54) TABLET PRINTING APPARATUS AND TABLET PRINTING METHOD

(71) Applicant: SHIBAURA MECHATRONICS CORPORATION, Yokohama-shi (JP)

(72) Inventors: Azusa Hirano, Yokohama (JP); Yasutsugu Tsuruoka, Yokohama (JP); Hironori Haijima, Yokohama (JP); Ryo Ikuta, Yokohama (JP)

(73) Assignee: SHIBAURA MECHATRONICS CORPORATION, Yokohama-shi (JP)

( * ) Notice: Subject to any disclaimer, the term of this patent is extended or adjusted under 35 U.S.C. 154(b) by 0 days.

(21) Appl. No.: 16/132,935

(22) Filed: Sep. 17, 2018

(65) Prior Publication Data

US 2019/0084318 A1 Mar. 21, 2019

(30) Foreign Application Priority Data

Sep. 19, 2017 (JP) ..... 2017-179119
Jul. 20, 2018 (JP) ..... 2018-137093

(51) Int. Cl.

| | |
|---|---|
| ***B41J 3/407*** | (2006.01) |
| ***B41J 11/42*** | (2006.01) |
| ***A61J 3/06*** | (2006.01) |
| ***B41J 11/00*** | (2006.01) |
| ***B41J 2/045*** | (2006.01) |
| ***B41F 17/36*** | (2006.01) |
| *A61J 3/00* | (2006.01) |

(52) U.S. Cl.
CPC ..... *B41J 3/407* (2013.01); *A61J 3/06* (2013.01); *B41F 17/36* (2013.01); *B41J 2/04531* (2013.01); *B41J 11/002* (2013.01); *B41J 11/007* (2013.01); *B41J 11/42* (2013.01); *A61J 3/007* (2013.01)

(58) Field of Classification Search
CPC ..... B41J 3/407; B41J 2/04531; B41J 11/002; B41J 11/007; B41J 11/42; B41F 17/36; A61J 3/06
See application file for complete search history.

(56) References Cited

U.S. PATENT DOCUMENTS

2017/0158900 A1* 6/2017 Willems ..... B41J 2/2114

FOREIGN PATENT DOCUMENTS

| | | |
|---|---|---|
| JP | 7-81050 | 3/1995 |
| JP | 9-323019 A | 12/1997 |
| JP | WO2016/194761 A1 | 12/2016 |

* cited by examiner

*Primary Examiner* — Lamson D Nguyen
(74) *Attorney, Agent, or Firm* — Oblon, McClelland, Maier & Neustadt, L.L.P.

(57) ABSTRACT

According to one embodiment, a tablet printing apparatus includes: a conveying path where a tablet is conveyed; a drying device configured to dry the tablet in the conveying path; and a print head device located on the downstream side of the drying device in the conveying path. The print head device is configured to perform printing on the tablet dried by the drying device.

13 Claims, 9 Drawing Sheets

CONVEYANCE AMOUNT CHECK RESULT

| CONDITION | DRYING BEFORE PRINTING | DRYING AFTER PRINTING | TABLET AMBIENT HUMIDITY, WEIGHT CHANGE RATE | | |
|---|---|---|---|---|---|
| | | | RH70%, ⊿0.9% | RH50%, ⊿0% | RH6%, ⊿−1.0% |
| 1 | – | – | 250,000 TABLETS/H | 380,000 TABLETS/H | 450,000 TABLETS/H |
| 2 | – | ○ | 250,000 TABLETS/H | 380,000 TABLETS/H | 450,000 TABLETS/H |
| 3 | ○ | ○ | 300,000 TABLETS/H | 420,000 TABLETS/H | 450,000 TABLETS/H |

CONVEYANCE AMOUNT CHECK RESULT

| CONDITION | DRYING BEFORE PRINTING | DRYING AFTER PRINTING | TABLET AMBIENT HUMIDITY, WEIGHT CHANGE RATE | | |
|---|---|---|---|---|---|
| | | | RH70%, ⊿0.9% | RH50%, ⊿0% | RH6%, ⊿−1.0% |
| 1 | – | – | 250,000 TABLETS/H | 380,000 TABLETS/H | 450,000 TABLETS/H |
| 2 | – | ○ | 250,000 TABLETS/H | 380,000 TABLETS/H | 450,000 TABLETS/H |
| 3 | ○ | ○ | 300,000 TABLETS/H | 420,000 TABLETS/H | 450,000 TABLETS/H |

FIG. 6
TRANSFER RATE CHECK RESULT
| CONDITION | DRYING BEFORE PRINTING | DRYING AFTER PRINTING | TABLET AMBIENT HUMIDITY, WEIGHT CHANGE RATE | | |
|---|---|---|---|---|---|
| | | | RH70%, ⊿0.9% | RH50%, ⊿0% | RH6%, ⊿−1.0% |
| 1 | – | – | 21% | 5% | 0% |
| 2 | – | ○ | 10% | 3% | – |
| 3 | ○ | ○ | 8% | 0% | – |
FIG. 7
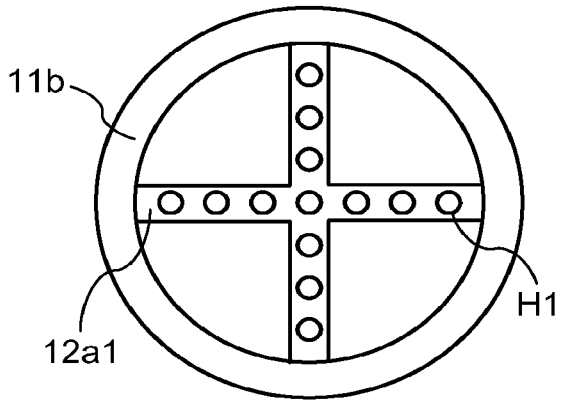
FIG. 8
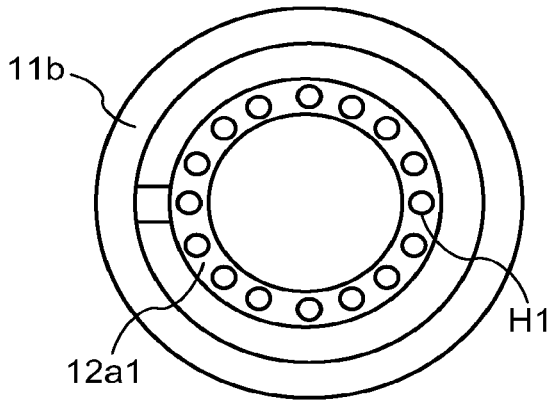

TABLET PRINTING APPARATUS AND TABLET PRINTING METHOD

CROSS-REFERENCE TO THE RELATED APPLICATION

This application is based upon and claims the benefit of priority from Japanese Patent Applications No. 2017-179119, filed on Sep. 19, 2017 and No. 2018-137093, filed on Jul. 20, 2018; the entire contents of all of which are incorporated herein by reference.

FIELD

Embodiments described herein relate generally to a tablet printing apparatus and a tablet printing method.

BACKGROUND

A technique that uses an inkjet print head to preform printing is known for printing identification information such as characters, letters, marks or the like on a tablet. In a tablet printing apparatus using this technique, tablets are conveyed by a conveying device such as a conveyor. Ink (for example, edible ink) is ejected from a nozzle of the inkjet print head located above the conveying device toward each tablet passing under the print head to print identification information on the tablet.

Generally, when a tablet has not sufficiently dried and contains moisture, the frictional force is increased between the surface of the tablet and the conveying path. Accordingly, the tablet does not slide smoothly over the conveying path of the tablet printing apparatus, and may not flow along the conveying path. Particularly, in a supply device configured to feed a large number of tablets and including, for example, a hopper, a duct and a chute, in the case of feeding tablets from the duct to the chute having a narrow conveying path, if the tablets have not sufficiently dried and contain moisture, they do not slide smoothly and do not flow well, resulting in clogging of the tablets in the chute. This reduces the number of tablets to be conveyed, and thus the productivity decreases.

Besides, if the tablets have not sufficiently dried and contain moisture, when printing is performed on the tablets, the ink is less likely to permeate into the tablets. As a result, the ink on the tablets does not dry well, and the print is transferred to the tablets or the conveying path due to contact between the tablets, the tablets being conveyed upside down, or the like. This reduces the printing quality, and the apparatus is contaminated.

BRIEF DESCRIPTION OF THE DRAWINGS

FIG. 6 is an explanatory diagram for explaining a transfer rate according to the embodiment;

FIG. 7 is a plan view illustrating an insertion tube according to a first modification of the embodiment;

FIG. 8 is a plan view illustrating an insertion tube according to a second modification of the embodiment;

DETAILED DESCRIPTION

According to one embodiment, a tablet printing apparatus includes: a conveying path where a tablet is conveyed; a drying device configured to dry the tablet in the conveying path; and a print head device located on the downstream side of the drying device in the conveying path. The print head device is configured to perform printing on the tablet dried by the drying device.

According to another embodiment, a tablet printing method includes: drying, by a drying device, a tablet in a conveying path where the tablet is conveyed; and performing printing, by a print head device located on the downstream side of the drying device in the conveying path, on the tablet dried by the drying device.

An embodiment will be described with reference to the drawings. Incidentally, the terms "above" and "below" as used herein refer to "above" and "below" in the vertical direction. Tablets T may be, for example, coated tablets. Examples of the coated tablets include sugar-coated tablets, film-coated tablets, and the like.

Basic Configuration

Figure 1:
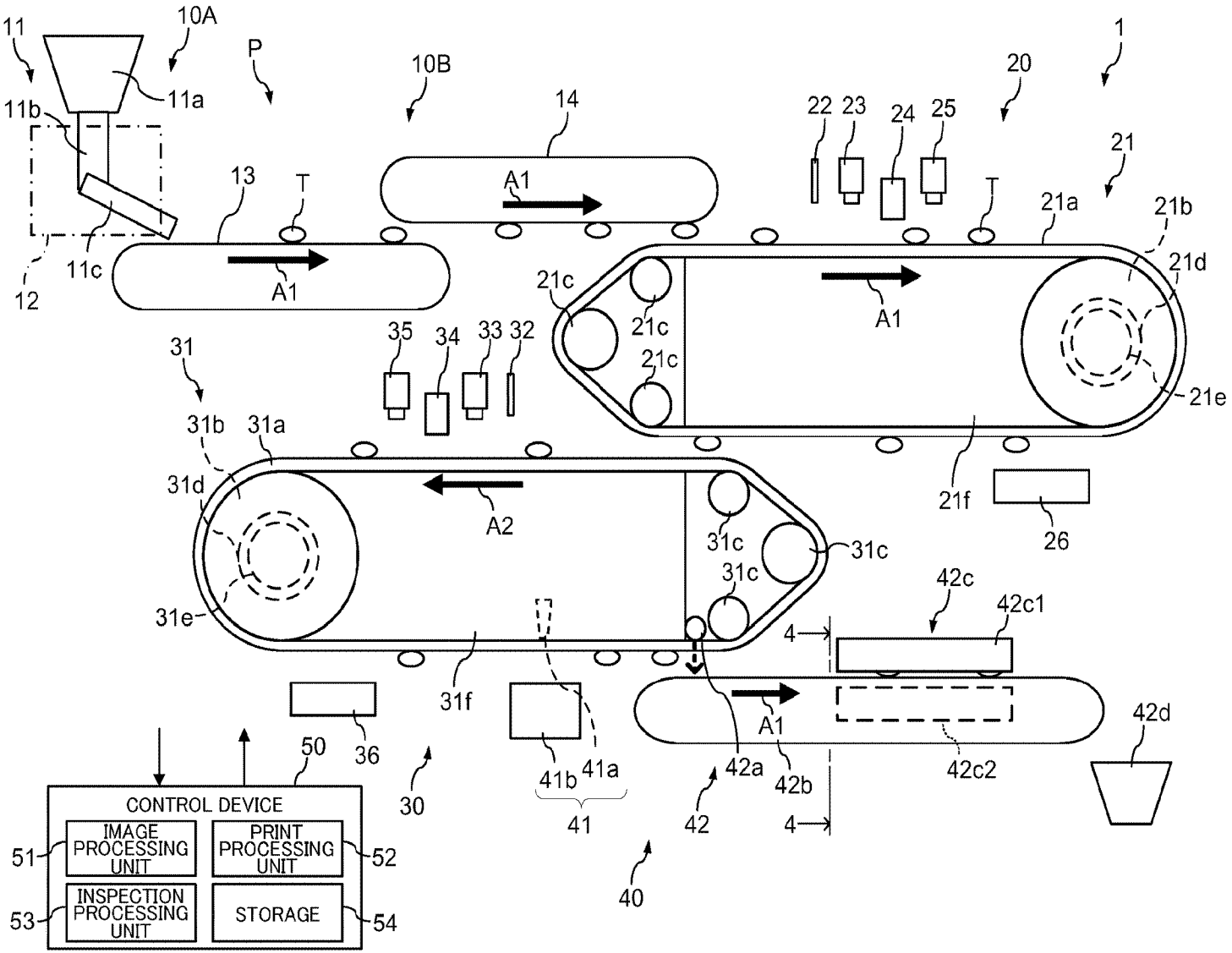
FIG. 1 is a diagram illustrating the schematic configuration of a tablet printing apparatus according to an embodiment.

As illustrated in FIG. 1, a tablet printing apparatus 1 of an embodiment includes a drying supply device (drying supplier) 10A, an alignment conveyor device (alignment conveyor) 10B, a first printing device (printer) 20, a second printing device (printer) 30, a collecting device (collector) 40, and a control device (controller) 50. The first printing device 20 and the second printing device 30 basically have the same structure. As will be described later, a series of processes of tablet supply, printing, and collection are performed while tablets T are being conveyed through the conveying path P (hereinafter, reference letter P will be omitted) where the drying supply device 10A, the alignment conveyor device 10B, the first printing device 20, the second printing device 30, and the collecting device 40, which are constituent elements of the tablet printing apparatus 1, are arranged in this order. That is, the conveying path refers to a path through which the tablets T are conveyed in the tablet printing apparatus 1. In this embodiment, the upstream side of the conveying path is the drying supply device 10A side, while the downstream side of the conveying path is the collecting device 40 side.

The drying supply device 10A includes a supply device (supplier) 11 and a drying device (drier) 12. The drying supply device 10A is located at an end of the alignment conveyor device 10B, i.e., at an end on the upstream side in the conveying direction A1 of the tablets T (hereinafter simply referred to as "conveying direction A1"). The drying supply device 10A is configured to be capable of drying the tablets T in the supply device 11 by the drying device 12 and supplying the dried tablets T to the alignment conveyor device 10B. The drying supply device 10A is electrically connected to the control device 50, and is driven under the control of the control device 50.

The supply device 11 includes a hopper 11*a*, a duct 11*b*, and a vibration feeder (chute) 11*c*. The hopper 11*a* stores a number of tablets T and sequentially supplies the tablets T to the duct 11*b*. The duct 11*b* is connected to the lower surface of the hopper 11*a*, and supplies each of the tablets T supplied from the hopper 11*a* to the vibration feeder 11*c*. The vibration feeder 11*c* supplies the tablets T to the alignment conveyor device 10B while vibrating the tablets T supplied from the lower surface of the duct 11*b* such that the tablets T are not one on top of another. In the supply device 11, the tablets T fall and move due to their own weight; however, for the sake of convenience, it is described herein that "the tablets T are conveyed" in the supply device 11.

In the supply device 11, for example, 100,000 tablets T are fed into the hopper 11*a* per hour (100,000 tablets/H). However, not all the tablets T in the hopper 11*a* are immediately supplied to the alignment conveyor device 10B through the duct 11*b* and the vibration feeder 11*c*. A large number of tablets T stay temporarily in the hopper 11*a*, the duct 11*b*, and the vibration feeder 11*c*.

Figure 2:
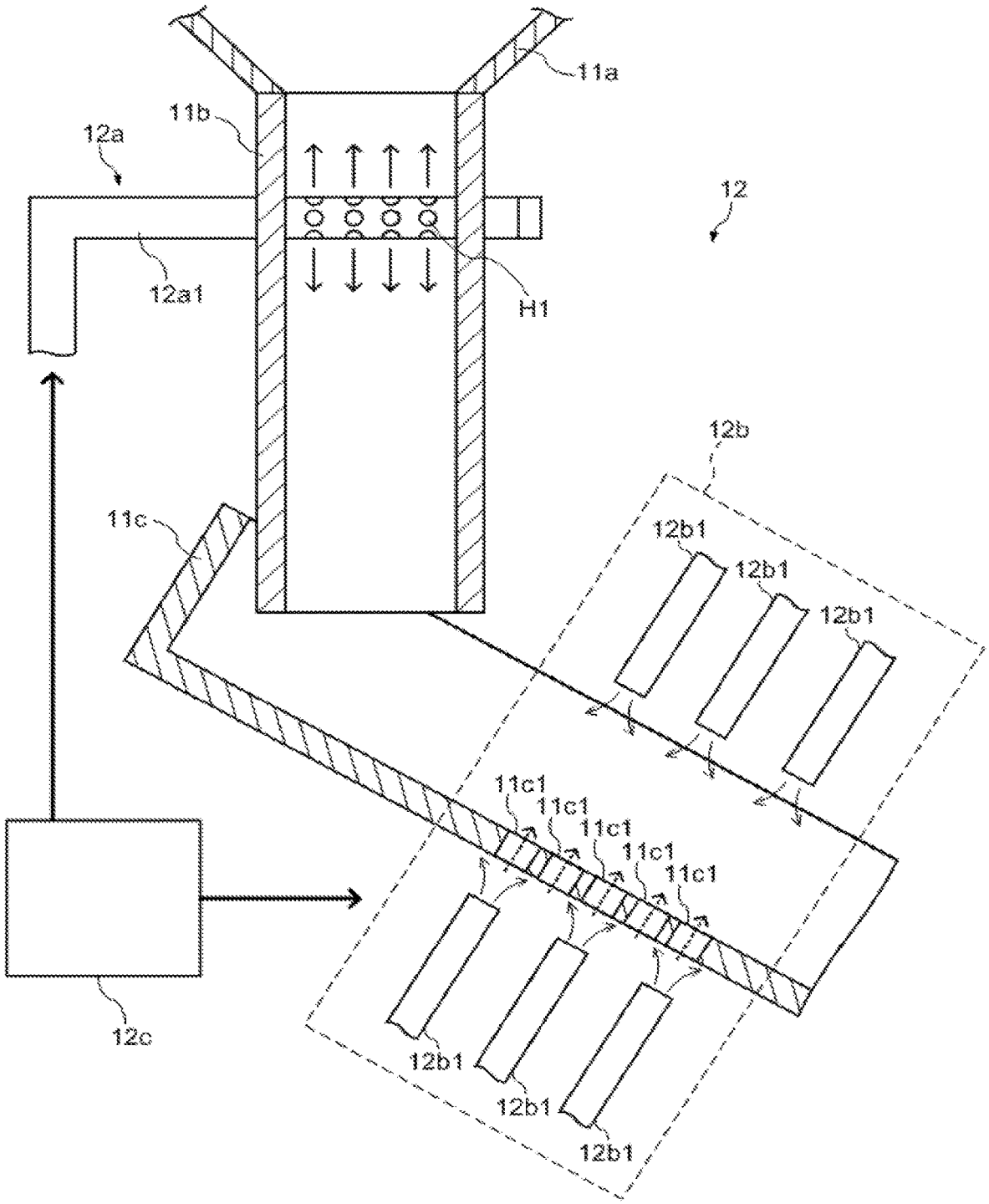
FIG. 2 is a diagram illustrating a part of a supply device and a drying device of the embodiment.

As illustrated in FIG. 2, the drying device 12 includes a first drying unit (drier) 12*a*, a second drying unit (drier) 12*b*, and a gas supply unit (gas supplier) 12*c*. In the drying device 12, the first drying unit 12*a* and the second drying unit 12*b* dry tablets T before printing by using dry gas (for example, dry air) supplied from the gas supply unit 12*c*. The drying device 12 need not necessarily be a device that dries an object with dry gas, and various types of dryers such as a blower for drying an object with gas such as air, a heater for drying an object by radiation heat, a device for drying an object with worm air or hot air by a blower and a heater, or the like can be used. However, if the tablet T is a coated tablet, the coating layer may melt with the temperature rise. Therefore, it is desirable to use a dryer which does not raise the temperature of the coating layer (this applies to other drying devices described later).

The first drying unit 12*a* includes an insertion tube 12*a*1. The insertion tube 12*a*1 is inserted in the duct 11*b* so as to penetrate therethrough substantially horizontally. One end of the insertion tube 12*a*1 is connected to the gas supply unit 12*c*, and the other end is closed. A plurality of through holes (air supply ports) H1 are formed in the part of the insertion tube 12*a*1 located in the duct 11*b* such that the insertion tube 12*a*1 has a gas permeability in the duct 11*b*. Since the through holes H1 of the insertion tube 12*a*1 are open also near the center axis of the duct 11*b*, the tablets T can reliably contact the dry gas while being conveyed near the center axis of the duct 11*b*, and thereby can be dried sufficiently. The insertion tube 12*a*1 is arranged such that the through holes H1 for supplying dry gas are located closer to the hopper 11*a*. For example, the insertion tube 12*a*1 is arranged such that the through holes H1 are located on the hopper 11*a* side than the center of the duct 11*b* in the longitudinal direction. With this, the space inside the hopper 11*a* is filled with the dry gas by the first drying unit 12*a*.

The second drying unit 12*b* includes a plurality of nozzles 12*b*1. Each of the nozzles 12*b*1 is arranged so as to blow out dry gas from around the vibration feeder 11*c* toward the conveying path of the vibration feeder 11*c*. A plurality of through holes 11*c*1 are formed in the lower surface of the vibration feeder 11*c* so that dry gas can pass therethrough. One end of each of the nozzles 12*b*1 is connected to the gas supply unit 12*c* via a pipe (not illustrated), and the other end is open as an air supply port.

The gas supply unit 12*c* supplies dry gas (for example, dry air) to the first drying unit 12*a* and the second drying unit 12*b*. The dry gas in the gas supply unit 12*c* is supplied to the insertion tube 12*a*1, passes through the insertion tube 12*a*1, and is blown out from each of the through holes H1 to be supplied into the duct 11*b*. Thereby, the tablets T in the duct 11*b* and the hopper 11*a* are dried. The dry gas in the gas supply unit 12*c* is supplied to the nozzles 12*b*1 via a pipe (not illustrated), and blown out from the air supply port of each of the nozzles 12*b*1 to be supplied into the vibration feeder 11*c*. At this time, the dry gas is supplied to the vibration feeder 11*c* from around it. Thus, each of the tablets T in the vibration feeder 11*c* is dried.

Referring back to FIG. 1, the alignment conveyor device 10B includes an alignment feeder 13 and a transfer feeder 14. The alignment conveyor device 10B is located on one end side of the first printing device 20, i.e., at an end on the upstream side in the conveying direction A1. The alignment conveyor device 10B is configured to be capable of supplying the tablets T to the first printing device 20 by the alignment feeder 13 and the transfer feeder 14. The alignment conveyor device 10B is electrically connected to the control device 50, and is driven under the control of the control device 50.

The alignment feeder 13 aligns the supplied tablets T in two rows and conveys them to the transfer feeder 14. The transfer feeder 14 sequentially sucks the tablets T aligned in two rows on the alignment feeder 13 from above to hold them. The transfer feeder conveys the tablets T in two rows to the first printing device 20 while holding them, and supplies them to the first printing device 20. As the alignment feeder 13 and the transfer feeder 14, for example, a belt conveying mechanism can be used.

The first printing device 20 includes a conveying device (conveyor) 21, a detecting device (detector) 22, a first imaging device (imaging device (imager) for printing) 23, a print head device (print head) 24, a second imaging device (imaging device (imager) for inspection) 25, and a drying device (drier) 26.

The conveying device 21 includes a conveyor belt 21*a*, a driving pulley 21*b*, a plurality of driven pulleys 21*c* (three in the example of FIG. 1), a motor 21*d*, a position detector 21*e*, and a suction chamber 21*f*. The conveyor belt 21*a* is an endless belt, and wrapped around the driving pulley 21*b* and each of the driven pulleys 21*c*. The driving pulley 21*b* and the driven pulleys 21*c* are rotatably provided to the apparatus main body, and the driving pulley 21*b* is connected to the motor 21*d*. The motor 21*d* is electrically connected to the control device 50, and is driven under the control of the control device 50. The position detector 21*e* is a device such as an encoder and is attached to the motor 21*d*. The position detector 21*e* is electrically connected to the control device 50, and sends a detection signal to the control device 50. The control device 50 can obtain information such as the position, speed, and movement amount of the conveyor belt 21*a* based on the detection signal. In the conveying device 21, the conveyor belt 21*a* is rotated together with the driven pulleys 21*c* due to the rotation of the driving pulley 21*b* caused by the motor 21*d*, and the tablets T on the conveyor belt 21*a* are conveyed in the direction of arrow A1 in FIG. 1 (conveying direction A1).

Figure 3:
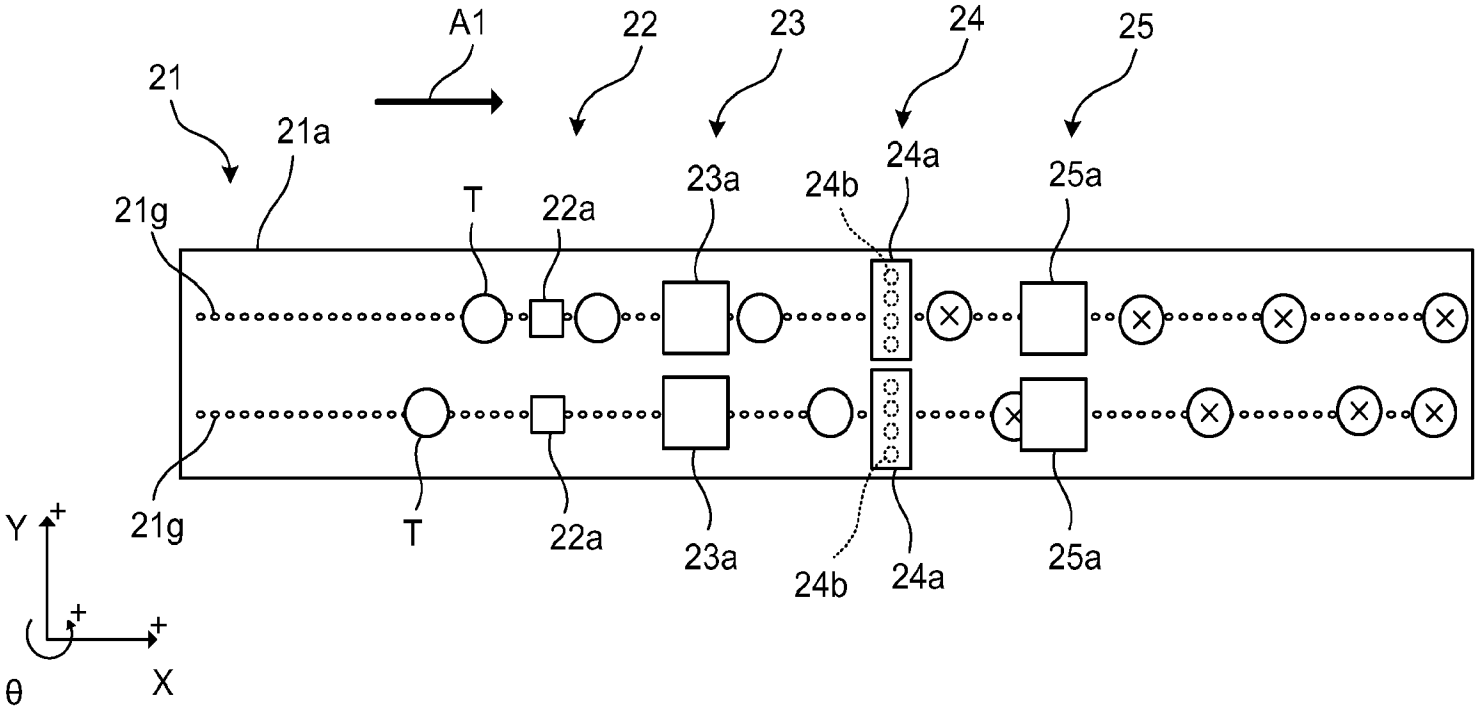
FIG. 3 is a plan view illustrating a first printing device of the embodiment.

As illustrated in FIG. 3, a plurality of circular suction holes 21*g* are formed on the surface of the conveyor belt 21*a*. The suction holes 21*g* are through holes for sucking and holding the tablets T on the surface of the conveyor belt 21*a*, and are arranged in two rows in parallel along the conveying direction A1 so as to form two conveying paths. Each of the suction holes 21*g* is connected to the inside of the suction chamber 21*f* through a suction path formed in the suction chamber 21*f* to obtain suction force from the suction chamber 21*f*. The suction chamber 21*f* is connected to a suction device (not illustrated) such as a pump through a suction pipe (not illustrated), and the inside of the suction chamber 21*f* is depressurized by the operation of the suction device. The suction pipe is connected to substantially the center of a side surface (a surface parallel to the conveying direction A1) of the suction chamber 21*f*. The suction device is electrically connected to the control device 50, and is driven under the control of the control device 50.

The detecting device 22 includes a plurality of detectors 22*a* (two in the example of FIG. 3). The detectors 22*a* are located on the downstream side of the position where the tablet T is supplied by the alignment conveyor device 10B on the conveyor belt 21*a* in the conveying direction A1. The detectors 22*a* are arranged in a direction crossing the conveying direction A1 (for example, a direction perpendicular to the conveying direction A1) in the horizontal plane, one for each conveying path of the tablets T, and located above the conveyor belt 21*a*. Each of the detectors 22*a* detects the position (the position in the conveying direction A1) of the tablet T on the conveyor belt 21*a* by projecting and receiving laser beams, and functions as a trigger sensor of each device located on the downstream side. As the detectors 22*a*, various laser sensors such as reflection laser sensors can be used. Each of the detectors 22*a* is electrically connected to the control device 50, and sends a detection signal to the control device 50.

The first imaging device 23 includes a plurality of imaging units (imagers) 23*a* (two in the example of FIG. 3). The imaging units 23*a* are located on the downstream side of the position where the detecting device 22 is located in the conveying direction A1. The imaging units 23*a* are arranged in a direction crossing the conveying direction A1 (for example, a direction perpendicular to the conveying direction A1) in the horizontal plane, one for each conveying path of the tablets T, and located above the conveyor belt 21*a*. Each of the imaging units 23*a* performs imaging at the time when the tablet T reaches just under the imaging unit 23*a* based on the position information of the tablet T to capture an image (image for printing) including the upper surface of the tablet T, and sends the image to the control device 50. As the imaging units 23*a*, various cameras having an imaging device such as a charge-coupled device (CCD) or a complementary metal-oxide semiconductor (CMOS) can be used. Each of the imaging units 23*a* is electrically connected to the control device 50, and is driven under the control of the control device 50. There may also be provided an illumination for imaging as necessary.

The print head device 24 includes a plurality of ink jet print heads 24*a* (two in the example of FIG. 3). The print heads 24*a* are located on the downstream side of the position where the first imaging device 23 is located in the conveying direction A1. The print heads 24*a* are arranged in a direction crossing the conveying direction A1 (for example, a direction perpendicular to the conveying direction A1) in the horizontal plane, one for each conveying path of the tablets T, and located above the conveyor belt 21*a*. Each of the print heads 24*a* has a plurality of nozzles 24*b* (see FIG. 3: only four nozzles are illustrated in the figure), and ejects ink from the nozzles 24*b* individually. Each of the print heads 24*a* is arranged such that the alignment direction of the nozzles 24*b* crosses (for example, perpendicularly to) the conveying direction A1 in the horizontal plane. As the print heads 24*a*, various ink jet print heads having a drive element such as a piezoelectric element, a heating element, a magnetostrictive element or the like can be used. Each of the print heads 24*a* is electrically connected to the control device 50, and is driven under the control of the control device 50.

The second imaging device 25 includes a plurality of imaging units (imagers) 25*a* (two in the example of FIG. 3). The imaging units 25*a* are located on the downstream side of the position where the print head device 24 is located in the conveying direction A1. The imaging units 25*a* are arranged in a direction crossing the conveying direction A1 (for example, a direction perpendicular to the conveying direction A1) in the horizontal plane, one for each conveying path of the tablets T, and located above the conveyor belt 21*a*. Each of the imaging units 25*a* performs imaging at the time when the tablet T reaches just under the imaging unit 25*a* based on the position information of the tablet T to capture an image (image for inspection) including the upper surface of the tablet T, and sends the image to the control device 50. Similarly to the imaging units 23*a*, various cameras having an imaging device such as CCD or CMOS can be used as the imaging units 25*a*. Each of the imaging units 25*a* is electrically connected to the control device 50, and is driven under the control of the control device 50. There may also be provided an illumination for imaging as necessary.

Referring back to FIG. 1, the drying device 26 is located on the downstream side of the position where the print head device 24 is located in the conveying direction A1, and is arranged, for example, below the conveying device 21. The drying device 26 is shared in the two conveying paths, and is configured to dry the ink applied to each tablet T on the conveyor belt 21*a*. As the drying device 26, various types of dryers such as a blower for drying an object with gas such as air, a heater for drying an object by radiation heat, a device for drying an object with worm air or hot air by a blower and a heater, or the like can be used. The drying device 26 is electrically connected to the control device 50, and is driven under the control of the control device 50.

The tablet T passing above the drying device 26 is conveyed along with the movement of the conveyor belt 21*a* and reaches a position near the end of the conveyor belt 21*a* on the driven pulleys 21*c* side. At this position, the sucking action does not work on the tablet T. The tablet T is released from the hold of the conveyor belt 21*a*, and is transferred from the first printing device 20 to the second printing device 30.

The second printing device 30 includes a conveying device (conveyor) 31, a detecting device (detector) 32, a first imaging device (imaging device (imager) for printing) 33, a print head device (print head) 34, a second imaging device (imaging device (imager) for inspection) 35, and a drying device (drier) 36. The conveying device 31 includes a conveyor belt 31*a*, a driving pulley 31*b*, a plurality of driven pulleys 31*c* (three in the example of FIG. 1), a motor 31*d*, a position detector 31*e*, and a suction chamber 31*f*. Each constituent element of the second printing device 30 has basically the same structure as the corresponding constituent element of the first printing device 20 described above. Therefore, the explanation will be omitted. In FIG. 1, arrow A2 indicates the conveying direction of the second printing device 30 (conveying direction A2).

The collecting device 40 includes a defective product collecting device (collector) 41 and a non-defective product (good product) collecting device (collector) 42. The collecting device 40 is located on the downstream side of the position where the drying device 36 of the second printing device 30 is located in the conveying direction A2. The collecting device 40 collects defective tablets T by the defective product collecting device 41 and collects non-defective tablets (good tablets) T by the non-defective product collecting device 42.

The defective product collecting device 41 includes an injection nozzle 41*a* and a container 41*b*. The injection nozzle 41*a* is provided in the suction chamber 31*f* of the second printing device 30. The injection nozzle 41*a* injects a gas (for example, air) toward the tablet T (defective tablet T) conveyed by the conveyor belt 31*a* to drop the tablet T from the conveyor belt 31*a*. At this time, the gas injected from the injection nozzle 41*a* passes through suction holes (similar to the suction holes 21*g* illustrated in FIG. 3) of the conveyor belt 31*a* and hits the tablet T. The injection nozzle 41*a* is electrically connected to the control device 50, and is driven under the control of the control device 50. The container 41*b* receives and stores the tablet T dropped from the conveyor belt 31*a*.

The non-defective product collecting device 42 includes a gas blower 42*a*, a discharge conveyor (discharge feeder) 42*b*, a drying device (drier) 42*c*, and a container 42*d*. The non-defective product collecting device 42 is located on the downstream side of the position where the defective product collecting device 41 is located in the conveying direction A2.

The gas blower 42*a* is arranged at the end of the conveying device 31 in the conveying device 31 of the second printing device 30 (i.e., at the end of the conveyor belt 31*a* on the driven pulleys 31*c* side). During the printing process, for example, the gas blower 42*a* constantly blows a gas (for example, air) toward the conveyor belt 31*a* to drop the tablet T from the conveyor belt 31*a*. At this time, the gas blown out from the gas blower 42*a* passes through suction holes (similar to the suction holes 21*g* illustrated in FIG. 3) of the conveyor belt 31*a* and hits the tablet T. Examples of the gas blower 42*a* include an air blower having a slit-shaped opening extending in a direction crossing the conveying direction A2 in the horizontal plane (for example, a direction perpendicular to the conveying direction A2). The gas blower 42*a* is electrically connected to the control device 50, and is driven under the control of the control device 50.

The tablet T having passed through the defective product collecting device 41 is conveyed along with the movement of the conveyor belt 31*a*, and reaches a position near the end of the conveyor belt 31*a* on the driven pulleys 31*c* side. At this position, the sucking action does not work on the tablet T. However, with the gas blower 42*a*, the tablet T can be reliably dropped from the conveyor belt 31*a* and supplied to the discharge conveyor 42*b*.

The discharge conveyor 42*b* receives the tablet T dropped from the lower surface of the conveyor belt 31*a* and conveys it to the container 42*d*. For example, a belt conveyor mechanism can be used as the discharge conveyor 42*b*. The belt of the discharge conveyor 42*b* is an endless belt that has a gas permeability. As the belt having a gas permeability may be cited belts made of various materials and having a plurality of through holes, such as a net belt or a belt having a plurality of round holes. The discharge conveyor 42*b* is electrically connected to the control device 50, and is driven under the control of the control device 50.

The drying device 42*c* includes an upper drying unit (drier) 42*c*1 and a lower drying unit (drier) 42*c*2. In the drying device 42*c*, the upper drying unit 42*c*1 and the lower drying unit 42*c*2 dry the tablets T conveyed by the discharge conveyor 42*b* by using dry gas (for example, dry air). The drying device 42*c* is electrically connected to the control device 50, and is driven under the control of the control device 50. The drying device 42*c* need not necessarily be a device that dries an object with dry gas, and various types of dryers such as a blower for drying an object with gas such as air, a heater for drying an object by radiation heat, a device for drying an object with worm air or hot air by a blower and a heater, or the like can be used.

The upper drying unit 42*c*1 is arranged above the discharge conveyor 42*b* with a space to allow the tablets T to pass through, and blows dry gas (for example, dry air) downward from above the discharge conveyor 42*b*. The upper drying unit 42*c*1 is connected to the gas supply unit 12*c* (see FIG. 2) via a pipe (not illustrated), and uses dry gas supplied from the gas supply unit 12*c* for drying treatment. The housing of the upper drying unit 42*c*1 is formed in a box shape with an opening in its lower surface. The upper drying unit 42*c*1 is arranged such that the lower surface thereof is directed downward so as to cover the conveyor surface, i.e., the upper surface of the belt of the discharge conveyor 42*b*. A nozzle (not illustrated) for blowing dry gas is arranged in the housing of the upper drying unit 42*c*1. The nozzle is configured to blow dry gas toward the upper surface of the belt of the discharge conveyor 42*b*. The dry gas flows along the conveying path of the discharge conveyor 42*b* toward the upstream end and the downstream end of the discharge conveyor 42*b*. As a result, the space in the housing of the upper drying unit 42*c*1 is always maintained in a dry atmosphere.

The lower drying unit 42*c*2 is arranged inside the discharge conveyor 42*b*, and blows dry gas (for example, dry air) upward from the inside of the discharge conveyor 42*b*. Similarly to the upper drying unit 42*c*1, the lower drying unit 42*c*2 is also connected to the gas supply unit 12*c* (see FIG. 2) via a pipe (not illustrated), and uses dry gas supplied from the gas supply unit 12*c* for drying treatment. The housing of the lower drying unit 42*c*2 is formed in a box shape with an opening in its upper surface. The lower drying unit 42*c*2 is arranged in the discharge conveyor 42*b* such that the upper surface thereof is directed upward. A nozzle (not illustrated) for blowing dry gas is arranged in the housing of the lower drying unit 42*c*2. The nozzle is configured to blow dry gas toward the lower surface of the belt of the discharge conveyor 42*b*. Together with the dry gas blown out from the upper drying unit 42*c*1, the dry gas flows along the conveying path of the discharge conveyor 42*b* toward the upstream end and the downstream end of the discharge conveyor 42*b*. As a result, the space in the housing of the lower drying unit 42*c*2 is always maintained in a dry atmosphere.

Figures 4, 5:
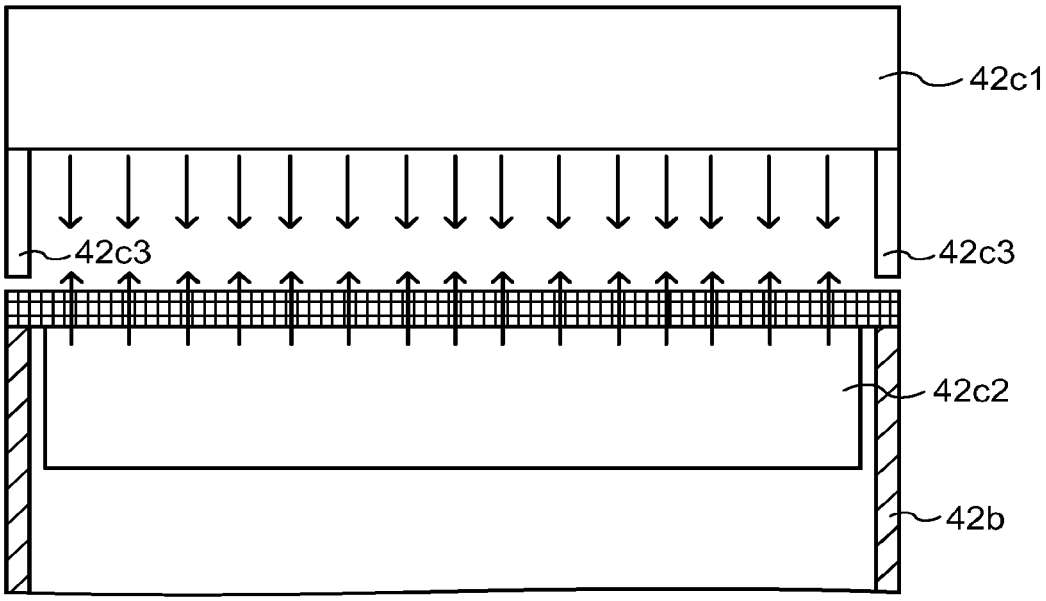
FIG. 4 is a cross-sectional view taken along line 4-4 of FIG. 1.
FIG. 5 is an explanatory diagram for explaining a conveyance amount according to the embodiment.

As illustrated in FIG. 4, the upper drying unit 42*c*1 is provided with a side cover 42*c*3 on the side surface of its housing. The side cover 42*c*3 is arranged over the entire area of both side surfaces of the upper drying unit 42*c*1 parallel to the conveying direction A1. The side cover 42*c*3 extends in the vertical direction to the vicinity of the belt of the discharge conveyor 42*b*. With the side cover 42*c*3, a space extending in the conveying direction A1 is defined between the upper drying unit 42c1 and the discharge conveyor 42b. This facilitates the dry gas blown into this space to flow toward the upstream end and the downstream end of the discharge conveyor 42b. Accordingly, air flows flowing toward the upstream end and the downstream end of the discharge conveyor 42b are easily formed. Besides, since the dry gas is continuously supplied into the space, the inside of the space is a positive pressure atmosphere filled with the dry gas, which suppress the inflow of the highly humid outside air. Therefore, the inside of the space is always maintained in a dry atmosphere. The same applies to the lower drying unit 42c2.

The nozzle arranged in the upper drying unit 42c1 and the lower drying unit 42c2 may be in any form. For example, the nozzle may include one or more pipes having a plurality of openings that align in the longitudinal direction thereof for blowing dry gas through the openings. The pipes may be arranged such that the longitudinal direction is along the conveying direction A1 or crosses (for example, perpendicularly to) the conveying direction A1.

Referring back to FIG. 1, the container 42d is located at the end of the discharge conveyor 42b on the downstream side, i.e., at the end of the discharge conveyor 42b on the opposite side of the second conveying device 31, outside the housing of the tablet printing apparatus 1. The container 42d receives the tablets T having the ink dried by the drying device 42c from the discharge conveyor 42b and stores them.

The control device 50 includes an image processing unit (image processer) 51, a print processing unit (print processer) 52, an inspection processing unit (inspection processer) 53, and a storage 54. The image processing unit 51 processes an image. The print processing unit 52 performs processing related to printing. The inspection processing unit 53 performs processing related to inspection. The storage 54 stores various information such as processing information and various programs. The control device 50 controls the drying supply device 10A, the alignment conveyor device 10B, the first printing device 20, the second printing device 30, and the collecting device 40. The control device 50 receives position information of the tablets T sent from each of the detecting devices 22 and 32 of the first printing device 20 and the second printing device 30, images sent from each of the imaging devices 23, 25, 33 and 35 of the first printing device 20 and the second printing device 30, and the like.

The conveying speed of the discharge conveyor 42b (for example, 30 mm/s) is set to be lower than the conveying speed of the conveying device 21 and the conveying device 31 (for example, 380 mm/s). For example, the conveying speed of the discharge conveyor 42b is set to about one tenth of the conveying speed of the conveying devices 21 and 31. In other words, the tablets T move more slowly in the discharge conveyor 42b than during printing.

Printing Process

Next, a description will be given of printing process and inspection process performed by the tablet printing apparatus 1.

First, various information such as print data required for printing is stored in the storage 54 of the control device 50. Then, when a number of tablets T to be printed are put in the hopper 11a of the supply device 11, the tablets T flow into the duct 11b from the hopper 11a. The tablets T in the duct 11b are sequentially supplied to the alignment feeder 13 by the vibration feeder 11c, and moved as being aligned in two rows by the alignment feeder 13. The transfer feeder 14 sequentially supplies the tablets T moving in two rows to the conveyor belt 21a of the first printing device 20. The conveyor belt 21a is rotating in the conveying direction A1 with the rotation of the driving pulley 21b and the driven pulleys 21c caused by the motor 21d. Accordingly, the tablets T supplied onto the conveyor belt 21a are conveyed at a predetermined moving speed in two rows on the conveyor belt 21a. The conveyor belt 31a is also rotating in the conveying direction A2 with the rotation of the driving pulley 31b and the driven pulleys 31c caused by the motor 31d.

When a large number of tablets T (for example, hundreds of thousands of tablets) are fed into the hopper 11a, not all the tablets T in the hopper 11a are immediately supplied to the alignment conveyor device 10B through the duct 11b and the vibration feeder 11c. Many of the tablets T stay temporarily in the hopper 11a, the duct 11b, and the vibration feeder 11c. These tablets T are dried by the first drying unit 12a and the second drying unit 12b. Specifically, the first drying unit 12a supplies dry gas into the hopper 11a and the duct 11b, and the space inside the hopper 11a and the duct 11b is filled with the dry gas. Accordingly, the internal humidity (humidity around the tablets T) decreases, and the tablets T in the hopper 11a and the duct 11b are dried. At this time, the tablets T in the hopper 11a and the duct 11b stay in the space of the dry gas for about ten minutes to one hour, and thereby are dried reliably. The second drying unit 12b blows dry gas to the tablets T moved from the duct 11b to the vibration feeder 11c, i.e., the tablets T in the vibration feeder 11c. This promotes the drying of the tablets T.

Incidentally, the timing of starting the supply of dry gas is the timing at which the dry gas is supplied at the same time as the tablet printing apparatus 1 is started (turned on) before the supply of the tablets T is started and the inside of the supply device 11 (inside of the hopper 11a, the duct 11b, and the vibration feeder 11c) becomes dry at a stage before the timing at which the tablets are supplied.

Thereafter, in the first printing device 20, the detecting device 22 detects each of the tablets T on the conveyor belt 21a. Thereby, position information (the position in the conveying direction A1) of the tablet T is acquired and fed to the control device 50. The position information of the tablet T is stored in the storage 54 and used for post-processing. Next, the first imaging device 23 captures an image of the tablet T on the conveyor belt 21a at the timing based on the position information of the tablet T, and sends the image to the control device 50. The image processing unit 51 generates position deviation information of the tablet T (for example, position deviation of the tablet T in the X direction, the Y direction, and the e direction in FIG. 3) based on each image received from the first imaging device 23. The position deviation information is stored in the storage 54. The print processing unit 52 sets printing conditions (ejection position and ejection speed of the ink, etc.) for the tablet T based on the position deviation information of the tablet T. The printing conditions are stored in the storage 54.

Subsequently, the print head device 24 performs printing on each of the tablets T on the conveyor belt 21a based on the printing conditions at the timing based on the position information of the tablet T, i.e., at the timing when the tablet T reaches below the print head device 24. In each of the print heads 24a of the print head device 24, ink is appropriately ejected from each of the nozzles 24b. Thus, identification information such as a letter (for example, alphabet, kana, number), a mark (for example, symbol or figure), or the like is printed on the upper surface of the tablet T.

The second imaging device 25 captures an image of the tablet T having the identification information printed thereon at the timing based on the position information of the tablet T, and sends the image to the control device 50. The image processing unit 51 generates print position information indicating the print position of the print pattern for each of the tablets T based on each image received from the second imaging device 25. The print position information is stored in the storage 54. The inspection processing unit 53 determines whether the print on the tablet T is acceptable based on the print position information, and print quality determination result information indicating the result of print quality determination is stored in the storage 54 for each tablet T. For example, it is determined whether the print pattern is printed at a predetermined position on the tablet T.

The tablet T after the inspection is conveyed with the movement of the conveyor belt 21*a* and passes above the drying device 26. At this time, the drying device 26 dries the ink that has reached (landed on) the tablet T while the tablet T is passing above the drying device 26. The tablet T having the ink dried is conveyed with the movement of the conveyor belt 21*a*, and arrives in the vicinity of the end of the conveyor belt 21*a* on the driven pulleys 21*c* side. At this position, the sucking action no longer works on the tablet T. The tablet T is released from the hold to the lower surface of the conveyor belt 21*a*, and is transferred from the first printing device 20 to the second printing device 30.

After that, the second printing device 30 also performs the printing process and the inspection process in the same manner as described above. The tablet T after the inspection is conveyed with the movement of the conveyor belt 31*a* and passes above the drying device 36. Then, the tablet T with the ink dried reaches the defective product collecting device 41. At this position, if the tablet T is defective, it is dropped from the lower surface of the conveyor belt 31*a* by the gas ejected from the injection nozzle 41*a* and collected in the container 41*b*. If not, the non-defective tablet T passes through the defective product collecting device 41, and reaches the non-defective product collecting device 42. At this position, the sucking action no longer works on the tablet T, and the gas blower 42*a* blows out gas. As a result, the non-defective tablet T is dropped from the lower surface of the conveyor belt 31*a*, and is transferred to the discharge conveyor 42*b*.

While the non-defective tablet T is being conveyed by the discharge conveyor 42*b*, the upper drying unit 42*c*1 and the lower drying unit 42*c*2 of the drying device 42*c* dry the tablet T. As being blown with the dry gas from the upper drying unit 42*c*1 and the lower drying unit 42*c*2, the tablet T on the belt of the discharge conveyor 42*b* is maintained in a dry state. Even if the tablet T absorbs moisture due to the humidity in the conveying path on the upstream of the discharge conveyor 42*b*, the tablet T can be reliably dried by the upper drying unit 42*c*1 and the lower drying unit 42*c*2 while being conveyed by the discharge conveyor 42*b*. Since the partition space defined by the side cover 42*c*3 (see FIG. 4) above the discharge conveyor 42*b* is filled with the dry gas, the internal humidity decreases, and the tablet T in the partition space is dry. At this time, the conveying speed of the discharge conveyor 42*b* is very slow as compared with the conveying speed at the time of printing. Accordingly, the tablet T in the partition space stays within the partition space of the dry gas for about ten minutes and is dried sufficiently. This also applies to the ink printed on the tablet T, and the ink can be maintained in a dry state. Further, even if the ink is not dried sufficiently, it can be dried reliably.

The tablet T dried by the drying device 42*c* is conveyed by the discharge conveyor 42*b* to above the container 42*d*. The tablet T drops from the downstream end of the discharge conveyor 42*b*, and is collected in the container 42*d*.

With the printing process as described above, the tablets T are reliably dried by the drying device before printing is performed on the tablets T. Thus, when the tablet T is not sufficiently dried and contains moisture, it is possible to prevent such a situation that the tablet T does not slide smoothly and does not flow along the conveying path due to an increase in the frictional force between the surface of the tablet T and another tablet as well as the conveying path of the supply device 11 or the like. Therefore, it is possible to suppress a decrease in conveyance amount, thus to suppress a decrease productivity. Further, since the tablets T are reliably dried by the drying device 12 before printing, the ink easily permeates into the tablets T during printing. Accordingly, the ink on the tablets T is dried quickly. As a result, the print is prevented from being transferred to other tablets or the conveying path due to contact between the tablets, the tablets being conveyed upside down, or the like. Thereby, it is possible to suppress a decrease in printing quality and the contamination of the apparatus.

In addition, the tablets T before printing are also dried by the drying device 12 in the supply device 11, i.e., in the hopper 11*a*, the duct 11*b*, and the vibration feeder 11*c*. As the tablets T stay in the supply device 11 for about ten minutes to one hour, they can be dried reliably. That is, the tablets T are dried by the drying device 12 in the supply device 11, i.e., at a position where the tablets T move more slowly than when they move while the print head device 24 is performing printing on them. Thus, the tablets T can be dried reliably.

The tablets T are stored in a dry atmosphere in the supply device 11 by the drying supply device 10A after they are fed into the tablet printing apparatus 1. Thus, even if the tablets T are sufficiently dried before being fed into the tablet printing apparatus 1, it is possible to prevent such a situation that they may absorb moisture from the air in the supply device 11 having a long retention time. Besides, if the tablets T that contain moisture are fed to the tablet printing apparatus 1, they can be dried into an appropriate dry state. In other words, the tablets T can be maintained in a dry state in an atmosphere where the humidity is appropriately controlled from when they are fed into the tablet printing apparatus 1 until printing is performed.

The tablets T before printing are conveyed by passing through a space having a narrower conveying path on the downstream side than on the upstream side in order to align the tablets T fed in a large amount at the time of printing. The space is such as the space from the hopper 11*a* to the duct 11*b* or the space from the vibration feeder 11*c* to the transfer feeder 14 in the conveying path from the supply device 11 to the first printing device 20. The tablets T are dried by the drying device 12 before being aligned by the alignment feeder 13 in the supply device 11. Thereby, when the tablets T pass through the space where the conveying path is narrow, it is possible to prevent such a situation that the tablet T does not slide smoothly and does not flow along the conveying path due to an increase in the frictional force between the surface of the tablet T and another tablet as well as the conveying path of the supply device 11 or the like. Therefore, it is possible to suppress a decrease in conveyance amount, thus to suppress a decrease productivity.

Further, the tablets T after printing are dried by the drying device 26 and the drying device 36, and after that, the dry state of the tablets T is maintained by the drying device 42*c*. This prevents such a situation that the tablets contain moisture as having not been dried sufficiently and do not slide smoothly, resulting in the ink being transferred to the conveying path due to rubbing between the tablets T after printing and the conveying path, and to other tablets due to rubbing among them.

This is effective particularly when the tablets T are conveyed as being not sucked and held in, for example, the non-defective product collecting device 42. Even if being sucked and held, the tablets T may shift due to vibration or the like during the conveyance. In this case also, the ink transfer can be suppressed. Besides, although the drying device 26 and the drying device 36 dry the ink applied to the tablets T, the ink may not be sufficiently dried depending on the surface state of the tablets T and the type of the ink. Even in such a case, the drying device 42*c* promotes the drying of the ink, and thereby the ink transfer can be suppressed.

Conveyance Amount and Transfer Rate

FIGS. 5 and 6 illustrate the result of checking the conveyance amount of the tablets T and the transfer rate under a plurality of drying conditions. FIG. 5 illustrates the conveyance amount with respect to the tablet ambient humidity (input tablet left ambient humidity) and the weight change rate in Conditions 1 to 3. FIG. 6 illustrates the transfer rate with respect to the tablet ambient humidity and the weight change rate in Conditions 1 to 3.

Since the number of printable tablets depends on the number of tablets T supplied and conveyed to the printing device (20, 30), the conveyance amount of tablets T (conveyance amount per unit time) in the printing device (20, 30) was measured. In addition, the transfer rate of ink, i.e., the transfer state of the printed ink that was not dried sufficiently and adhered to other tablets T, the conveying members and the like was measured by a transfer test described later.

As the sample of the tablets T used for this check, tablets T having a predetermined hygroscopic state were prepared. The sample was prepared by exposing the tablets T to predetermined humidity environments until the moisture absorption of the tablets T was saturated, i.e., until the weight of the tablets T no longer changed, by measuring the weight with an electronic balance at regular time intervals.

The tablets T were left to be saturated in weight in those environments with a relative humidity of 70% (RH 70%), a relative humidity of 50% (RH 50%), and a relative humidity of 6% (RH 6%) as the predetermined humidity environments. The predetermined humidity environments were created by a high-temperature and constant-humidity storage. The state of the tablets T prepared in this manner is referred to as "tablet ambient humidity" and indicated with humidity %.

As the tablets T, sugar-coated tablets having a diameter of 7 mm and a thickness of 4.5 mm were used. The weight of the tablet T saturated in RH 50% environment (saturated weight) is taken as the reference weight, and the amount of change from the reference weight after the tablet was left in the environments of RH 70% and RH 6% to be saturated is taken as the weight change rate. The weight change rate indicates a change in the moisture amount contained in the tablet T.

Next, the drying device 12 for drying before printing and the drying devices 26, 36 and 42*c* for drying after printing were installed in the tablet printing apparatus 1. Then, printing was performed on the tablets T with each tablet ambient humidity under the conditions where the tablets T were dried or not before printing and after printing. As the drying conditions, three Conditions 1 to 3 described below were used.

Under each of the conditions, printing was performed on 70 thousand tablets. At this time, the number of tablets printed every 1 minute was measured for 10 minutes (10 times), and the average was calculated. The conveyance amount per hour was obtained from the measurement results. Besides, 30 tablets were randomly taken from those printed under each condition, and placed in a glass bottle. The glass bottle was swung up and down ten times, and then each of the tablets was visually checked for the presence or absence of dirt of 0.1 mm square or larger to count the number of tablets T having the dirt. The transfer rate was calculated from the measured value.

The drying before printing was performed in the configuration illustrated in FIG. 2 by supplying dry air into the duct 11*b* at a flow rate of 30 liters/minute and also supplying dry air at a flow rate of 50 liters/minute from above and below in the vibration feeder 11*c*. The drying after printing was performed by supplying dry air at a flow rate of 50 liters/minute with the drying devices 26 and 36 and supplying dry air at a flow rate of 50 liters/minute with both the upper drying unit 42*c*1 and the lower drying unit 42*c*2 of the drying device 42*c*. The relative humidity of the dry air was RH 6%.

The results obtained in this manner are illustrated in FIGS. 5 and 6 as described above. In Condition 1 in FIGS. 5 and 6, no drying was performed before and after printing. In Condition 2, the drying was not performed before printing but performed after printing. In Condition 3, the drying was performed before and after printing. Incidentally, the tablet ambient humidity refers to the humidity of the environment in which the tablets to be fed for printing were left for a predetermined period of time. The weight change rate is represented by the amount of change from the weight of RH 50%, and Δ0% indicates that the weight did not change from the weight of RH 50%. Besides, Δ0.9% indicates that the weight increased by 0.9% from the weight of RH 50%, and Δ−1.0% indicates that the weight decreased by 1.0% from the weight of RH 50%. The weight change rate indicates a change in the moisture amount contained in the tablets T.

In the cases where the tablet ambient humidity is RH 70% and the weight change rate is Δ0.9%, and where the tablet ambient humidity is RH 50% and the weight change rate is Δ0%, the tablets T to be fed have not sufficiently dried and contain moisture. On the other hand, when the tablet ambient humidity is RH 6% and the weight change rate is Δ−1.0%, the tablets T to be fed are sufficiently dried and do not contain moisture.

As illustrated in FIG. 5, when the tablet ambient humidity was RH 70% and the weight change rate was Δ0.9%, the conveyance amount was 250,000 tablets per hour (250,000 tablets/H) in Conditions 1 and 2, while the conveyance amount was 300,000 tablets per hour (300,000 tablets/H) in Condition 3. When the tablet ambient humidity was RH 50% and the weight change rate was Δ0%, the conveyance amount was 380,000 tablets per hour (380,000 tablets/hour) in Conditions 1 and 2, while the conveyance amount was 420,000 tablets per hour (420,000 tablets/H) in Condition 3. Further, when the tablet ambient humidity was RH 6% and the weight change rate was Δ−1.0%, the conveyance amount was 450,000 tablets per hour (450,000 tablets/H) in Conditions 1, 2, and 3.

As described above, the conveyance amount was the same in Conditions 1 and 2 regardless of the tablet ambient humidity. This indicates that drying after printing has little influence on the conveyance amount. In Condition 3, the conveyance amount was larger than that in Conditions 1 and 2 when the tablet ambient humidity was RH 70% and RH 50%. Meanwhile, the conveyance amount was the same under any condition when the tablet ambient humidity was RH 6%. This result indicates that the conveyance amount is influenced by the dry state of the tablets T, and the more the tablets are dried, the larger the conveyance amount is.

That is, it is found that, even when the tablets T to be fed have not sufficiently dried, the conveyance amount can be increased by the drying before printing according to the embodiment. It is also found that, if the tablets contain moisture at a level corresponding to the sample having a tablet ambient humidity of 6% RH, they can be regarded as being sufficiently dry, and do not reduce the conveyance amount. It is considered because, if the tablets T are sufficiently dried, less friction is generated among the tablets T and the conveying path when they are conveyed in the devices that supply and convey them such as the hopper 11*a*, the duct 11*b*, the vibration feeder 11*c*, the alignment feeder 13, and the like while coming in contact with one another as well as the conveying path. As a result, the conveying resistance is reduced or clogging is suppressed, and the conveyance amount is increased.

Incidentally, in the tablet printing apparatus 1, the tablets T are conveyed while being sucked and held in the transfer feeder 14, the conveying device 21 of the first printing device 20, and the conveying device 31 of the second printing device 30. Therefore, the aforementioned conveying resistance does not matter, and the drying after printing to further dry the tablets did not affect the conveyance amount.

As illustrated in FIG. 6, when the tablet ambient humidity is RH 70% and the weight change rate is Δ0.9%, the transfer rate is 21% in Condition 1, 10% in Condition 2, and 8% in Condition 3. When the tablet ambient humidity is RH 50% and the weight change rate is Δ0%, the transfer rate is 5% in Condition 1, 3% in Condition 2, and 0% in Condition 3. In addition, when the tablet ambient humidity is RH 6% and the weight change rate is Δ−1.0%, the transfer rate is 0% in Condition 1.

Note that, when the tablet ambient humidity is RH 6% and the weight change rate is Δ−1.0%, the transfer rate is 0% in Condition 1, and it may also be 0% in Conditions 2 and 3. This is because the tablets T to be fed are sufficiently dried under a tablet ambient humidity of RH 6%.

The transfer rate indicates how well the ink can be dried. The above results indicate that the ink can be very easily dried and is not to be transferred when the tablets are dry as those in a tablet ambient humidity of RH 6%. The relation between the transfer rate and the conditions can be represented as: transfer rate in Condition 1>transfer rate in Condition 2>transfer rate in Condition 3. Regardless of whether the tablet ambient humidity is RH 70% or RH 50%, the transfer rate is reduced in Condition 2 as compared to Condition 1. This indicates that the drying after printing is effective in reducing the transfer rate. Besides, regardless of whether the tablet ambient humidity is RH 70% or RH 50%, the transfer rate is reduced in Condition 3 as compared to Condition 2. This indicates that the drying before printing is also effective in reducing the transfer rate.

According to conventional methods, the transfer rate has been reduced mainly by drying after printing. However, it was found that the transfer rate can be further reduced by drying before printing. This is considered to be because when the tablets T are dried to some extent, more ink permeates when printed on the surface of the tablet T, and also the solvent or the like evaporates faster. The transfer rate is the lowest in Condition 3 as compared to that in Conditions 1 and 2. That is, the transfer rate can be suppressed when the tablets T are sufficiently dried by drying both before and after printing.

When the tablet ambient humidity is higher than RH 70%, the tablets T and the ink cannot be dried well, and the transfer rate may increase. On the other hand, when the tablet ambient humidity is lower than RH 6%, the tablets T are liable to crack or chip, and sometimes they crack or chip while being conveyed. Therefore, in order to suppress the increase of the transfer rate and the cracking or chipping of the tablets T, it is preferable to use the tablets T placed in an environment where the humidity is 6% or more and 70% or less. In other words, by drying the tablets T placed in an environment where the humidity is 6% or more and 70% or less, it is possible to suppress the increase of the transfer rate and the cracking or chipping of the tablets T. Thus, a decrease in productivity and printing quality can be suppressed, and the apparatus can be prevented from being contaminated.

As described above, according to the embodiment, there is provided the drying device 12 for drying the tablets T. The drying device 12 dries the tablets T conveyed by the conveying device 21, and printing is performed. That is, the tablets T are reliably dried by the drying device 12 before printing is performed thereon. Thereby, it is possible to prevent such a situation that the tablet T does not slide smoothly and does not flow along the conveying path due to containing moisture as having not been dried sufficiently. Therefore, it is possible to suppress a decrease in conveyance amount, thus to suppress a decrease productivity. Further, since the tablets T are reliably dried by the drying device 12 before printing, the ink easily permeates into the tablets T during printing. Accordingly, the ink on the tablets T is dried sufficiently. As a result, the print is prevented from being transferred to other tablets or the conveying path due to contact between the tablets, the tablets being conveyed upside down, or the like. Thereby, it is possible to suppress a decrease in printing quality and the contamination of the apparatus.

Other Embodiments

An ink jet print head device has been described as an example of the print head device 24 or 34; however, it is not so limited. For example, a transfer print head device using a transfer roll or a transfer pad can also be used.

Figure 9:
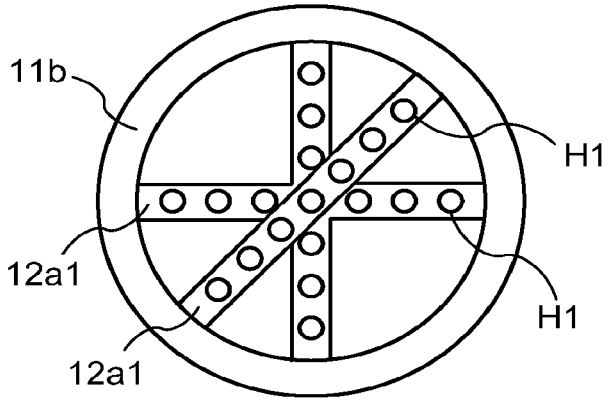
FIG. 9 is a plan view illustrating an insertion tube according to a third modification of the embodiment.
Figure 10:
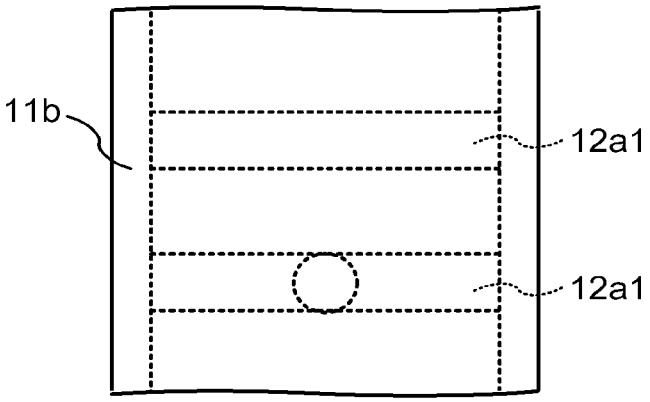
FIG. 10 is a side view illustrating the insertion tube according to the third modification of the embodiment.

The insertion tube 12*a*1 is described above as having a linear shape; however, this is by way of example and not limitation. For example, the insertion tube 12*a*1 may have a cross shape in a plan view as illustrated in FIG. 7, or a ring shape in a plan view as illustrated in FIG. 8. In addition to circular ring shape, examples of the ring shape include triangular ring shape, square ring shape, oval ring shape, and the like. As illustrated in FIGS. 9 and 10, the insertion tube 12*a*1 having a cross shape in a plan view may be provided in the duct 11*b*, and the linear insertion tube 12*a*1 may be provided in the duct 11*b* by changing its height position from the insertion tube 12*a*1 having the cross shape in a plan view such that the insertion tubes 12*a*1 are radial in a plan view. Besides, two insertion tubes (12*a*1) each having a linear shape may be arranged in the duct 11*b* at different heights so as to form a cross in a plan view. When a plurality of insertion tubes (12*a*1) are arranged at different positions in the height direction, they are less likely to interfere with the conveyance of the tablets T as compared to the case where the same number of insertion tubes (12*a*1) are located in the same plane.

Figure 11:
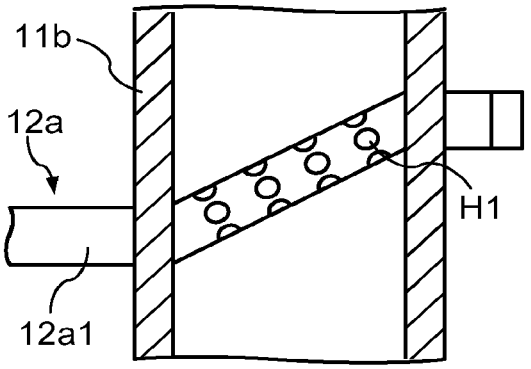
FIG. 11 is a front cross-sectional view illustrating an insertion tube according to a fourth modification of the embodiment.

The insertion tube 12*a*1 of the drying device 12 is described above as being inserted into the duct 11*b* so as to penetrate therethrough substantially horizontally; however, it is not so limited. For example, the insertion tube 12*a*1 may be inserted into the duct 11*b* so as to penetrate therethrough obliquely to the horizontal direction as illustrated in FIG. 11. The insertion tube 12*a*1 may also be inserted into the duct 11*b* from above in the vertical direction. Further, the number of the insertion tubes (12*a*1) may be increased to dry the tablets T more evenly. When inserted in the vertical direction, for example, the insertion tubes 12*a*1 may be arranged in the center and the periphery of the duct 11*b*, which enables more uniform drying of the tablets T. The insertion tube 12*a*1 need not necessarily have a circular cross-sectional shape. The insertion tube 12*a*1 may have a shape that reduces the resistance in a direction in which the tablets T move, and may have, for example, a triangular or oval cross-sectional shape.

Figure 12:
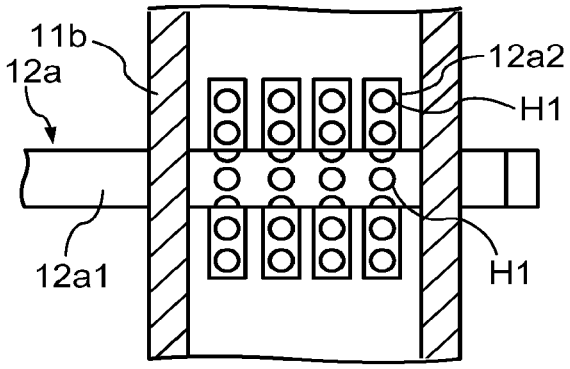
FIG. 12 is a front cross-sectional view illustrating an insertion tube according to a fifth modification of the embodiment.
Figure 13:
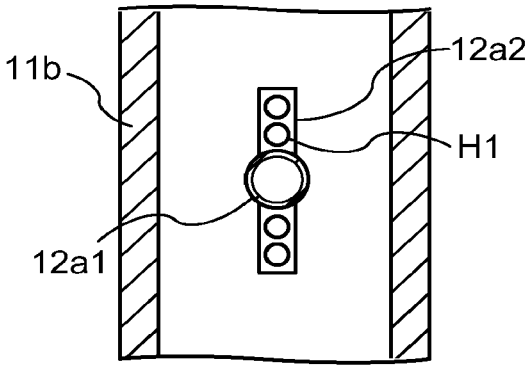
FIG. 13 is a side cross-sectional view illustrating the insertion tube according to the fifth modification of the embodiment.
Figure 14:
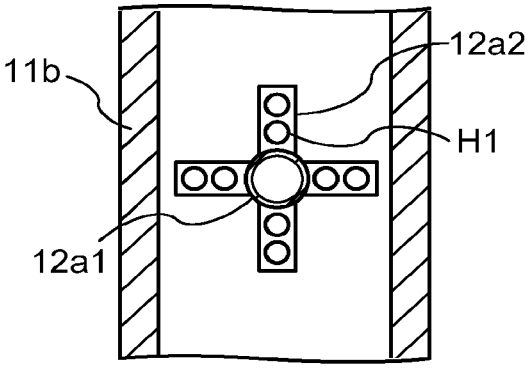
FIG. 14 is a side cross-sectional view illustrating an insertion tube according to a sixth modification of the embodiment.

The insertion tube 12*a*1 of the drying device 12 is described above as being inserted into the duct 11*b* so as to penetrate therethrough substantially horizontally. In addition, as illustrated in FIG. 12, the insertion tube 12*a*1 may be branched such that it has a plurality of branch tubes 12*a*2 on its peripheral surface in the duct 11*b*. Each of the branch tubes 12*a*2 is connected to the insertion tube 12*a*1. A plurality of through holes (air supply ports) H1 are formed in each of the branch tubes 12*a*2 as in the insertion tube 12*a*1 to provide them with gas permeability. As illustrated in FIGS. 12 and 13, the branch tubes 12*a*2 are arranged so as to face one another across the insertion tube 12*a*1 in the vertical direction. Further, as illustrated in FIG. 12, the branch tubes 12*a*2 are arranged in a direction in which the insertion tube 12*a*1 extends (horizontal direction). In addition to the above-described arrangement of the branch tubes 12*a*2, the branch tubes 12*a*2 may also be arranged so as to face one another across the insertion tube 12*a*1 in the horizontal direction as illustrated in FIG. 14.

Although some examples have been described above, the shape and arrangement of the insertion tube 12*a*1 may be arbitrary as long as not interfering with the conveyance of the tablets T. Desirably, the shape and arrangement of the insertion tube 12*a*1 are determined such that gas is not strongly blown to only one location but uniformly supplied into the duct 11*b* and many tablets T are dried and maintained in a dry state for a longer time.

Figure 15:
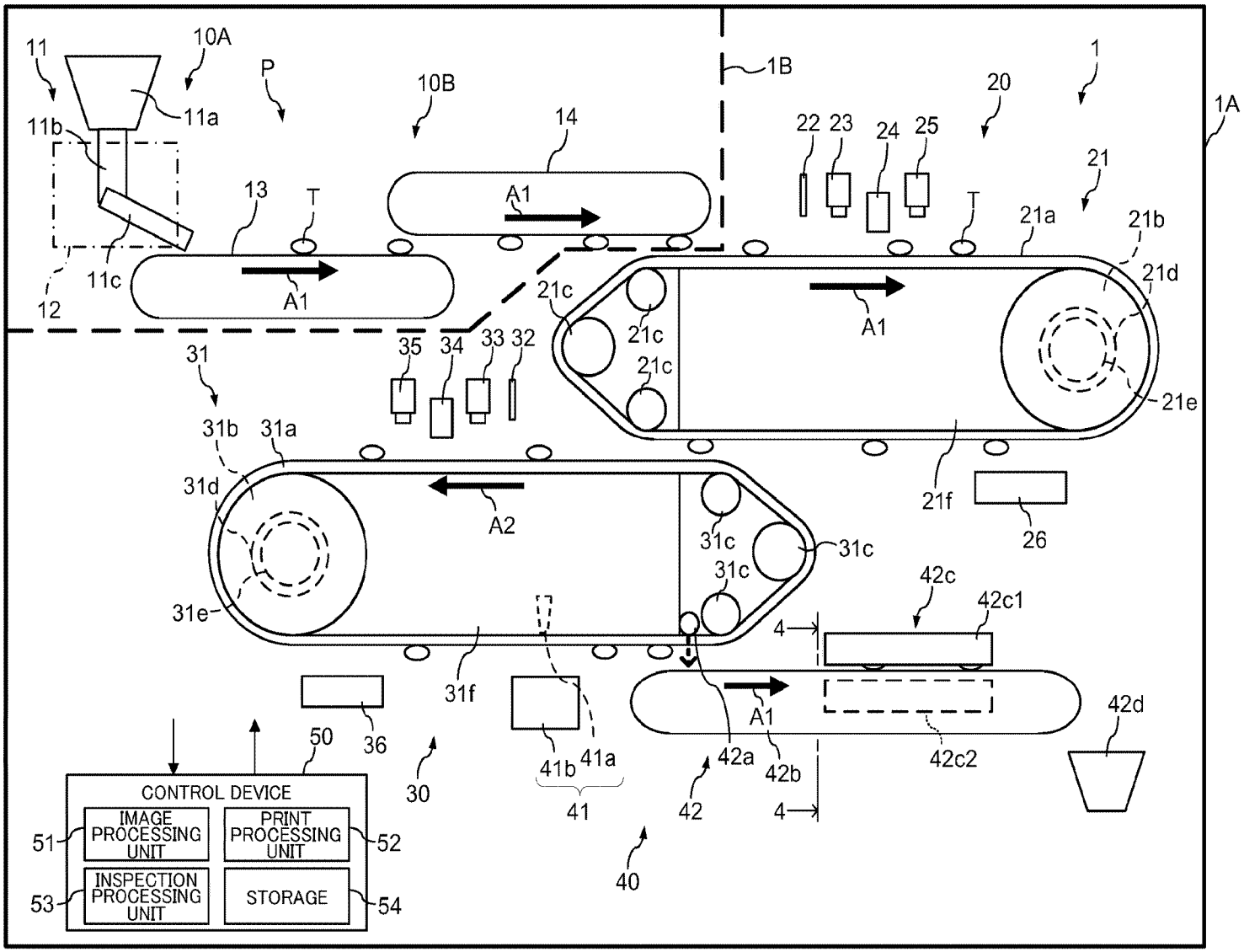
FIG. 15 is a diagram illustrating a tablet printing apparatus according to a modification of the embodiment.

A position in the supply device 11 is described above as the position before printing; this is by way of example and not limitation. For example, it may be a position in the alignment conveyor device 10B. For example, as illustrated in FIG. 15, the entire tablet printing apparatus 1 may be covered with a cover 1A. In this case, the drying supply device 10A and the alignment conveyor device 10B are further covered with a cover 1B, and the insertion tube 12*a*1 is provided as being inserted on the alignment conveyor device 10B side (near the alignment conveyor device 10B) in the cover 1B. The insertion tube 12*a*1 may be inserted, for example, above the alignment feeder 13 or below the transfer feeder 14. The insertion tube 12*a*1 may also be arranged in the hopper 11*a*.

A position in the supply device 11 is described above as the position where the tablets move more slowly than when they move while the print head device 24 is performing printing on them; however, this is by way of example and not limitation. For example, it may be a position in the alignment conveyor device 10B. In addition, although a position in the supply device 11 is described above as the position before alignment, it is not so limited. It may be, for example, a position on the upstream side of the alignment feeder 13.

The tablets T are described above as being conveyed in two rows; however, this is by way of example and not limitation. The number of rows is not particularly limited, and there may be one row, three rows, or four or more rows. The number of conveying paths and the number of conveying belts 13*a*, 21*a*, 31*a* are not particularly limited. In addition, the shape of the suction holes 13*f*, 21*g* of the conveyor belt 13*a*, 21*a*, 31*a* is also not particularly limited.

The print head 24*a* is described as being provided for each conveying path of the tablets T; however, this is by way of example and not limitation. For example, one print head 24*a* may perform printing on two or more rows of tablets T.

A print head in which the nozzles 24*b* are arranged in a row is exemplified above as the ink jet print head 24*a*; however, this is by way of example and not limitation. For example, a print head in which the nozzles 24*b* are arranged in a plurality of rows may be used. Further, the print heads 24*a* may be arranged along the conveying direction A1 of the tablets T.

The first printing device 20 and the second printing device 30 are described above as being arranged one on top of the other to perform printing on either one or both sides of the tablet T; however, this is by way of example and not limitation. For example, only the first printing device 20 may be provided to perform printing only on one side of the tablet T.

Dry air is described above as being used as the drying gas; however, this is by way of example and not limitation. For example, nitrogen or the like may be used. Particularly, when the oxidization of the tablets T to be dried is not wanted, it is preferable to use a gas which does not contain oxygen. Further, an inert gas such as argon or helium may also be used.

It has been described that there are provided the three drying devices 26, 36, and 42*c*; however, this is by way of example and not limitation. The number of the drying devices is not particularly limited. For example, drying may be performed by the two drying devices 36 and 42*c* without the drying device 26. Drying may also be performed by only the drying device 42*c* without the two drying devices 26 and 36, or by the drying devices 26 and 36 without the drying device 42*c*. There may also be cases where no drying device is required depending on the type of ink or tablets. In that case, all of the three drying devices 26, 36, and 42*c* may be eliminated. Further, the drying device 12 need not necessarily be provided with both the first drying unit 12*a* and the second drying unit 12*b*, and only one of them may suffice. However, it is preferable to use the first drying unit 12*a* at which the tablets stay longer for drying the tablets T.

Figure 16:
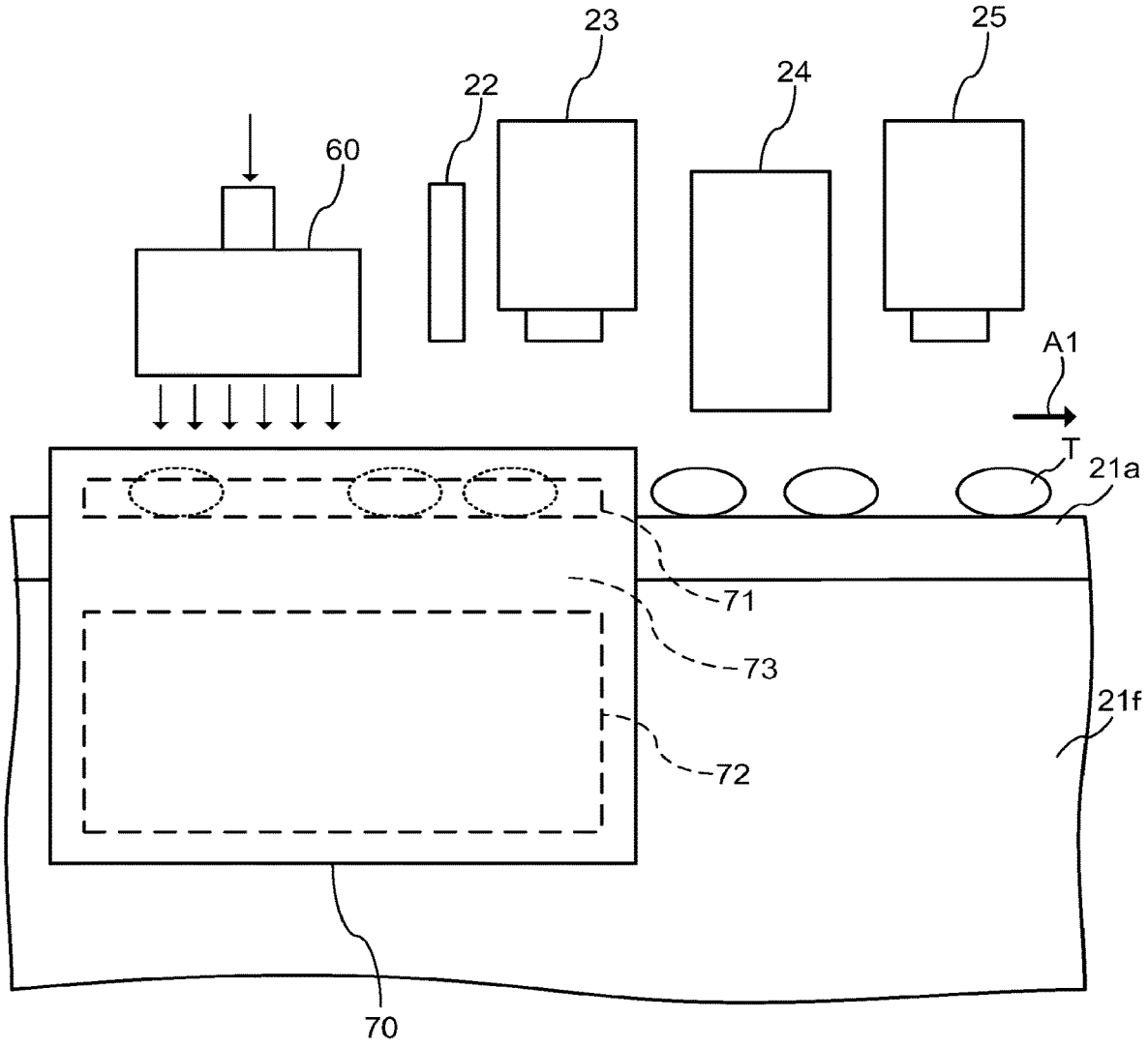
FIG. 16 is a diagram illustrating a drying device according to a modification of the embodiment.

There may also be provided a new drying device. For example, as illustrated in FIG. 16, a gas blower and a gas suction unit (aspirator) 70 may be provided as a drying device. The gas blower 60 is configured to blow dry gas from substantially the entire lower surface toward the upper surface of the conveyor belt 21*a*. The gas suction unit 70 includes an air inlet 71, an air outlet 72, and an internal flow path 73. The air inlet 71 is an opening for sucking air from the space of a region immediately before (upstream) of the print head device 24. The air inlet 71 has a rectangular shape (slit shape) extending in the conveying direction A1 of the tablets T, and is formed in a surface of the gas suction unit 70 on the conveyor belt 21*a* side at a position higher than the upper surface of the conveyor belt 21*a*. The air outlet 72 has a rectangular shape extending in the conveying direction A1 of the tablets T, and is formed in a surface of the gas suction unit 70 on the conveyor belt 21*a* side at a position lower than the lower surface of the conveyor belt 21*a*. The air outlet 72 is connected to the inside of the suction chamber 21*f*. The internal flow path 73 is a flow path that connects the air inlet 71 and the air outlet 72, and is formed inside the gas suction unit 70.

In this drying device, the gas blower 60 blows dry gas to the region immediately before the print head device 24. Besides, the inside of the suction chamber 21*f* is sucked, and the air is sucked from the air outlet 72 of the gas suction unit 70. Further, the air in the region immediately before the print head device 24 is sucked from the air inlet 71 through the internal flow path 73 connected to the air outlet 72. That is, the gas blower 60 blows dry gas to the region immediately before the print head device 24, and the gas suction unit 70 sucks the air, thereby enabling the region immediately upstream of the print head device 24 to be a dry area. With this, the tablets T passing through the dry area can be dried.

In the above embodiment, the timing of starting the supply of dry gas is set before the supply of the tablets T is started; however, it is not so limited. A shutter may be provided between the duct 11*b* and the vibration feeder 11*c* such that the supplied tablets T stay in the hopper 11*a* and the duct 11*b* for a predetermined period of time, and then dry gas may be supplied.

The above-described tablets may include tablets for pharmaceutical use, edible use, cleaning, industrial use, and aromatic use. Examples of the tablets include plain tablets (uncoated tablets), sugar-coated tablets, film-coated tablets, enteric coated tablets, gelatin coated tablets, multilayered tablets, dry-coated tablets, and the like. Examples of the tablets further include various capsule tablets such as hard capsules and soft capsules. The tablets may be in a variety of shapes such as, for example, a disk shape, a lens shape, a triangle shape, an oval shape, and the like. In the case where tablets to be printed are for pharmaceutical use or edible use, edible ink is suitably used. As the edible ink, any of synthetic dye ink, natural color ink, dye ink, and pigment ink may be used.

While certain embodiments have been described, these embodiments have been presented by way of example only, and are not intended to limit the scope of the inventions. Indeed, the novel embodiments described herein may be embodied in a variety of other forms; further, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A tablet printing apparatus, comprising:

a conveying path where a tablet is conveyed;

a drying device configured to dry the tablet in a supply device configured to supply the tablet to the conveying path or an alignment conveyor configured to convey the tablet supplied to the conveying path while aligning the tablet;

a print head device located on a downstream side of the drying device in the conveying path, and configured to perform printing on the tablet dried by the drying device; and a conveyor configured to convey the tablet on which printing is to be performed by the print head device along the conveying path, wherein a speed of conveying the tablet in the supply device or the alignment conveyor where the drying device is located, is slower than a speed of conveying the tablet in the conveyor.

2. The tablet printing apparatus according to claim 1, wherein the drying device is configured to dry the tablet that has stayed in an environment with a humidity of 6% or more and 70% or less.

3. The tablet printing apparatus according to claim 1, wherein the supply device includes a hopper configured to store a plurality of tablets, and a duct configured to convey the tablets sequentially supplied from the hopper, the drying device includes a first dryer, and the first dryer includes an insertion tube configured to be inserted in the duct and having a plurality of through holes, and a gas supplier configured to supply gas to the through holes of the insertion tube.

4. The tablet printing apparatus according to claim 3, wherein the insertion tube is located on a hopper side with respect to the center of the duct in a longitudinal direction.

5. The tablet printing apparatus according to claim 4, wherein the supply device further includes a vibration feeder configured to receive the tablets from the duct and convey the tablets, and the drying device further includes a second dryer that includes a plurality of nozzles configured to blow out the gas supplied from the gas supplier to the tablets conveyed by the vibration feeder.

6. The tablet printing apparatus according to claim 3, wherein the supply device further includes a vibration feeder configured to receive the tablets from the duct and convey the tablets, and the drying device further includes a second dryer that includes a plurality of nozzles configured to blow out the gas supplied from the gas supplier to the tablets conveyed by the vibration feeder.

7. The tablet printing apparatus according to claim 3, wherein the insertion tube is arranged in the duct so as to have a cross shape in a plan view.

8. The tablet printing apparatus according to claim 3, wherein the insertion tube is arranged in the duct so as to have a ring shape in a plan view.

9. The tablet printing apparatus according to claim 3, wherein the insertion tube is arranged obliquely in the duct in a side view.

10. The tablet printing apparatus according to claim 1, further comprising a controller configured to control the alignment conveyor and the conveyor such that the speed of conveying the tablet in the alignment conveyor is slower than the speed of conveying the tablet in the conveyor.

11. A tablet printing method, comprising:

supplying, by a supply device, a tablet to a conveying path where the tablet is conveyed;

conveying, by an alignment conveyor, the tablet supplied from the supply device while aligning the tablet;

drying, by a drying device, the tablet in the supply device or the alignment conveyor; and performing printing, by a print head device located on a downstream side of the drying device in the conveying path, on the tablet dried by the drying device, wherein a speed of conveying the tablet when the drying is performed by the drying device is slower than a speed of conveying the tablet when the printing is performed by the print head device.

12. The tablet printing method according to claim 11, wherein, in the drying, the drying device dries the tablet that has stayed in an environment with a humidity of 6% or more and 70% or less.

13. A tablet printing apparatus, comprising:

a conveying path where a tablet is conveyed;

a supply device configured to supply the tablet to the conveying path;

an alignment conveyor configured to convey the tablet supplied to the conveying path while aligning the tablet;

a cover configured to cover the supply device and the alignment conveyor;

a drying device configured to dry the tablet in the supply device and the alignment conveyor, which are covered by the cover;

a print head device located on a downstream side of the drying device and the cover in the conveying path, and configured to perform printing on the tablet dried by the drying device; and a conveyor configured to convey the tablet on which printing is to be performed by the print head device, wherein a speed of conveying the tablet in the supply device or the alignment conveyor where the drying device is located is slower than a speed of conveying the tablet in the conveyor.

* * * * *